US005729082A

United States Patent [19]

Snijkers

[11] Patent Number: 5,729,082

[45] Date of Patent: Mar. 17, 1998

[54] CATHODE STRUCTURE COMPRISING A HEATING ELEMENT

[75] Inventor: Franciscus M. M. Snijkers, Eindhoven, Netherlands

[73] Assignee: U.S. Philips Corporation, New York, N.Y.

[21] Appl. No.: 677,243

[22] Filed: Jul. 9, 1996

[30] Foreign Application Priority Data

Jul. 11, 1995 [EP] European Pat. Off. ..... 95201890

[51] Int. Cl.[6] ..... H01J 1/22

[52] U.S. Cl. ..... 313/346 R; 313/346 DC; 313/337; 313/341; 313/344; 313/270; 313/271

[58] Field of Search ..... 313/346 R, 346 DC, 313/337, 341, 342, 344, 270, 271

[56] References Cited

U.S. PATENT DOCUMENTS 4,745,325 5/1988 Koizumi ..... 313/341
5,426,351 6/1995 Imura ..... 313/344

OTHER PUBLICATIONS

Beriere et al., "Quick-vision CTV Picture Tube A66-410X", Philips Product Note, 1973, pp. 1-4.

*Primary Examiner*—Nimeshkumar Patel
*Attorney, Agent, or Firm*—Robert J. Kraus

[57] ABSTRACT

A cathode structure comprises at an end portion (1) an electron-emitting material (4) and a heating element (5) of wire (7), said cathode structure having a plurality of primary helical turns (8). These primary turns are used to form a first series of secondary turns (9) which are wound in a first direction with a pitch and which extend towards the end portion (1), and to form a second series of secondary turns (10) which extend from the end portion (1) and which have the opposite direction of winding yet the same pitch. Near the end portion (1), the first and second series of turns (9, 10) are interconnected by an arc-shaped connecting portion (12) having primary turns (8). This arc-shaped connecting portion (12) has a span $S_a$ and a rise $r_a$, the ratio $r_a/S_a$ preferably ranging from 0.3 to 0.5.

10 Claims, 7 Drawing Sheets

CATHODE STRUCTURE COMPRISING A HEATING ELEMENT

BACKGROUND OF THE INVENTION

The invention relates to a cathode structure which comprises an electron-emitting material at an end portion, and in which there is a filamentary heating element comprising a plurality of primary, helical turns with which a first series of secondary turns is formed, which are wound in a first direction with a pitch and which extend in the direction of said end portion, and with which a second series of secondary turns is formed which extend from said end portion and which are wound in the opposite direction yet with the same pitch, said first and second series of turns being interconnected at the end portion by a connecting portion with primary turns.

The invention further relates to a cathode ray tube comprising an electron source which includes a cathode structure which is provided with a heating element.

Cathode structures comprising heating elements are used in electron sources for cathode ray tubes, for example, in display devices for displaying monochromatic or colour images, camera tubes, video amplifiers and oscilloscopes.

Such a cathode structure is known from the brochure "Quick-Vision CTV Picture Tube A66-410X" by L. J. G. Berière and A. J. van IJzeren (Philips Product Note, 1973). In said document, a description is given of a tubular cathode structure in an electron gun for use in a cathode ray tube, which cathode structure comprises at an end portion a layer of an electron-emitting material to emit electrons. The cathode structure comprises a heating element which serves to heat the electron-emitting material. Said heating element comprises a wire having primary and secondary turns which is bifilarly wound in the form of a double helix. The secondary turns are built up from a first series of turns, which are wound in a first direction with a pitch and which extend in the direction of the end portion, and from a second series of turns which extend from the end portion and which are wound in the opposite direction yet with the same pitch. The first and second series of secondary turns are interconnected near to the end portion of the cathode structure by a connecting portion.

A drawback of the known cathode structure is that a number of the primary turns in the connecting portion may be short-circuited. These short-circuits occur, particularly in the primary turns in the transitions from the connecting portion to the first and second series of secondary turns. Due to the fact that the connecting portion is nearest to the electron-emitting material, the efficiency with which the heating element heats the electron-emitting material is adversely affected by these short-circuits.

SUMMARY OF THE INVENTION

It is an object of the invention to provide a cathode structure in which a short-circuit in the primary turns of the heating element near the end portion of the cathode structure is precluded and/or an improved distribution of the primary turns of the heating element near the end portion of the cathode structure is realised, so that the efficiency of the heating element is improved.

To this end, the heating element in accordance with the invention is characterized in that the connecting portion is arc-shaped with a span $S_a$ and a rise $r_a$, the ratio $r_a/S_a$ ranging from 0.1 to 1.0.

The advantage of an arc-shaped connecting portion is that, in said connecting portion, the primary turns are arranged in a flowing line relative to each other, that is, the distances between the primary turns in the connecting portion change gradually. In addition, an arc-shaped connecting portion causes the primary turns to be flowing, particularly in the transitions from the connecting portion to the first and second series of secondary turns, so that the risk of short-circuits between the primary turns is precluded.

The known cathode structure has a so-called "flat head" ($r_a/S_a \approx 0$), which is to be understood to mean that the connecting portion between the two transitions to the first and second series of secondary turns is situated in a plane transverse to a longitudinal axis of the cathode structure. As a result, in the known cathode structure the transitions from the connecting portion to the first and second series of secondary turns in the heating element are curved substantially.

In order to heat the electron-emitting material as effectively as possible, it is desirable that the turns of the heating element, particularly near the end portion, should be used as efficiently as possible. This can be achieved by using a wire with primary and secondary turns which is bifilarly wound in the form of a double helix instead of a single heating wire to build up the heating element. An efficient heating element is obtained if the density of the primary turns is relatively high, while electrical contact between the primary turns, particularly also in the connecting portion and in the transitions from the connecting portions to the first and the second series of secondary turns, is avoided. Given the span $S_a$ and a rise $r_a$ of the arc-shaped connecting portion, the primary turns can be closely spaced, while preventing a short-circuit between said primary turns by choosing the ratio $r_a/S_a$ to be in the range from 0.1 to 1.0.

An embodiment of the heating element in accordance with the invention is characterized in that the ratio $r_a/S_a$ ranges from 0.1 to 0.5.

If the ratio of the span to the rise of the arc-shaped connecting portion $r_a/S_a$ is 0.5, then the connecting portion is semi-circular. If the ratio $r_a/S_a$ is above 0.5, then the connecting portion has a pointed shape relative to the longitudinal axis of the cathode structure, so that the average distance from the primary turns of the connecting portion to the end portion of the cathode structure increases and the efficiency of the heating element decreases. If the ratio $r_a/S_a$ is chosen in the range from 0.1 to 0.5, the connecting portion obtains a (somewhat) flattened shape, as compared to a circular connecting portion which is obtained if $r_a/S_a=0.5$, and the primary turns are relatively closely spaced. By flattening the connecting portion, a more efficient heat dissipation is brought about, which is necessary to heat the electron-emitting material.

An embodiment of the heating element in accordance with the invention is characterized in that the ratio $r_a/S_a$ ranges from 0.3 to 0.5.

An optimum density of primary turns in the connecting portion of the heating element is obtained by choosing the ratio of the span to the rise of the arc-shaped connecting portion $r_a/S_a$ to be in the range from 0.3 to 0.5.

A preferred embodiment of the heating element in accordance with the invention is characterized in that, in the connecting portion, a diameter $d_w$ of the wire, an internal diameter $d_p$ of the primary turns and an average pitch $P_p$ of the primary turns satisfy the relationship:

$$(S_a/2 - d_p/2)\sin\left[\frac{P_p}{S_a/2 + d_p/2 + d_w}\right] \leqq 1.5\, d_w$$

in which the argument of the sine is expressed in radials.

Given a number of easily measurable parameters of the wire and the various winding ratios, the criterion which must be satisfied to preclude electrical contact between the primary turns, to be indicated by $f_w \leqq 1.5\, d_w$, is contained in the above formula.

A further embodiment of the heating element in accordance with the invention is characterized in that $$0.3\, d_w \leqq (S_a/2 - d_p/2)\sin\left[\frac{P_p}{S_a/2 + d_p/2 + d_w}\right] \leqq 1.5\, d_w$$

By observing a lower limit in the formula ($f_w \geqq 0.3\, d_w$) a safe margin for the minimum distance between the primary turns in the heating element is obtained, so that, also when the heating element is in operation to heat the electron-emitting material, the primary turns do not contact each other as a result of possible thermal expansion, and hence do not cause a short-circuit between the primary turns.

A further embodiment of the heating element in accordance with the invention is characterized in that $$0.3\, d_w \leqq (S_a/2 - d_p/2)\sin\left[\frac{P_p}{S_a/2 + d_p/2 + d_w}\right] \leqq 1.0\, d_w$$

In the known cathode structure having the so-called "flat head" ($r_a/S_a \approx 0$) short-circuits between the primary turns cannot be precluded if the various parameters of the heating wire in the formula $f_w$ are chosen to be such that the outcome of the formula does not exceed the upper limit to be observed by the formula ($f_w \leqq 1.0\, d_w$). However, the combination of an arc-shaped connecting portion with preconditions for the ratio $r_a/S_a$ as defined hereinabove, that is, in the range from 0.1 to 1.0, preferably from 0.1 to 0.5, in particular from 0.3 to 0.5, enables such values to be selected for the parameters of the heating wire (diameter $d_w$ of the wire, internal diameter $d_p$ of the primary turn, average pitch $P_p$ of the primary turn and span $S_a$ of the (arc-shaped) connecting portion) that the upper limit ($f_w \leqq 1.0\, d_w$) is not exceeded. In this manner, a low-power heating element without short-circuits is obtained which can attain high temperatures.

Within the framework of the invention, a thickness $d_w$ for the wire in excess of 20 μm, or an internal diameter $d_p$ of the primary turns in excess of 100 μm, or an average pitch $P_p$ of the primary turns below 50 μm, or a span $S_a$ of the connecting portion below 500 μm can now advantageously be used.

The above relations between the dimensions of the wire and the data about the winding ratios in the heating element enable those skilled in the art to design and use, in a simple manner, an efficient heating element for a cathode structure and hence to preclude short-circuits in the primary turns of the heating element near the end portion of the cathode structure and/or to achieve an improved distribution of the primary turns of the heating element near the end portion of the cathode structure. The inventors have recognized that, given a suitably chosen ratio of the span $S_a$ to the rise $r_a$, the use of an arc-shaped connecting portion enables wire parameters and winding ratios (diameter $d_w$ of the wire, internal diameter $d_p$ of the primary turn and the average pitch $P_p$ of the primary turn) in the connecting portion of the heating element to be chosen which, when $r_a/S_a$ is chosen to be 0, i.e. a so-called "flat" head, always cause a substantial number of short-circuits between the primary turns in the connecting portion. The formula $f_w$ provides those skilled in the art with a simple "tool" for choosing suitable wire parameters and winding ratios of the wire to be used for the connecting portion.

These and other aspects of the invention will be apparent from and elucidated with reference to the embodiments described hereinafter.

The Figures are purely schematic and not drawn to scale. In particular for clarity, some dimensions are exaggerated strongly.

Figure 1A:
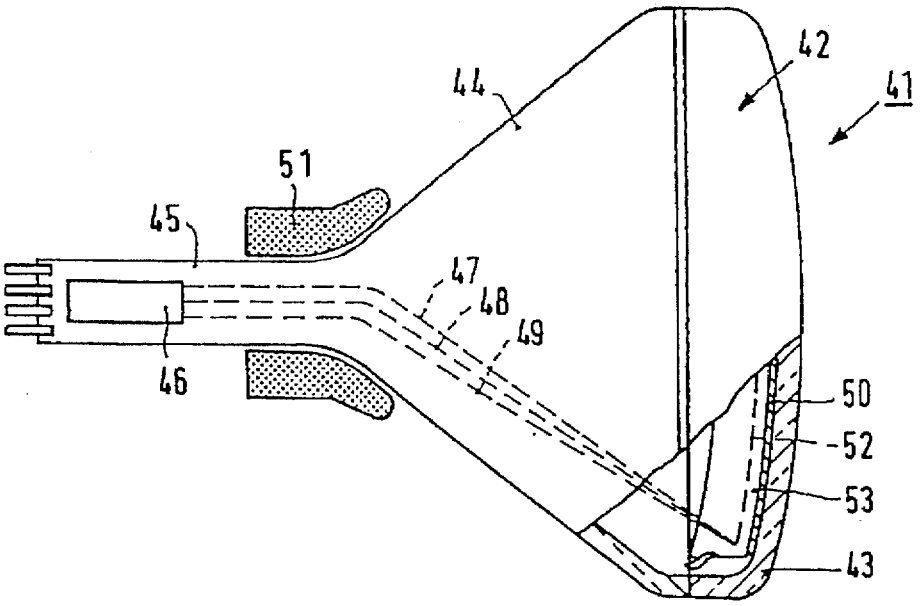
FIG. 1A is a schematic, cross-sectional view of a cathode ray tube.

FIG. 1A is a schematic, cross-sectional view of a cathode ray tube 41 comprising an evacuated envelope 42 having a display window 43, a cone portion 44 and a neck 45. In the neck 45 there is arranged an electron gun 46 for generating three electron beams 47, 48 and 49. A display screen 50 is situated on the inside of the display window. Said display window 50 comprises a pattern of phosphor elements luminescing in red, green and blue. On their way to the display screen 50, the electron beams 47, 48 and 49 are deflected across the display screen 49 by means of deflection unit 51 and pass through a shadow mask 52, which comprises a thin plate having apertures 53, and which is arranged in front of the display window 43. The three electron beams 47, 48 and 49 pass through the apertures 53 of the shadow mask 52 at a small angle with respect to each other and, consequently, each electron beam impinges on phosphor elements of only one color.

Figure 1B:
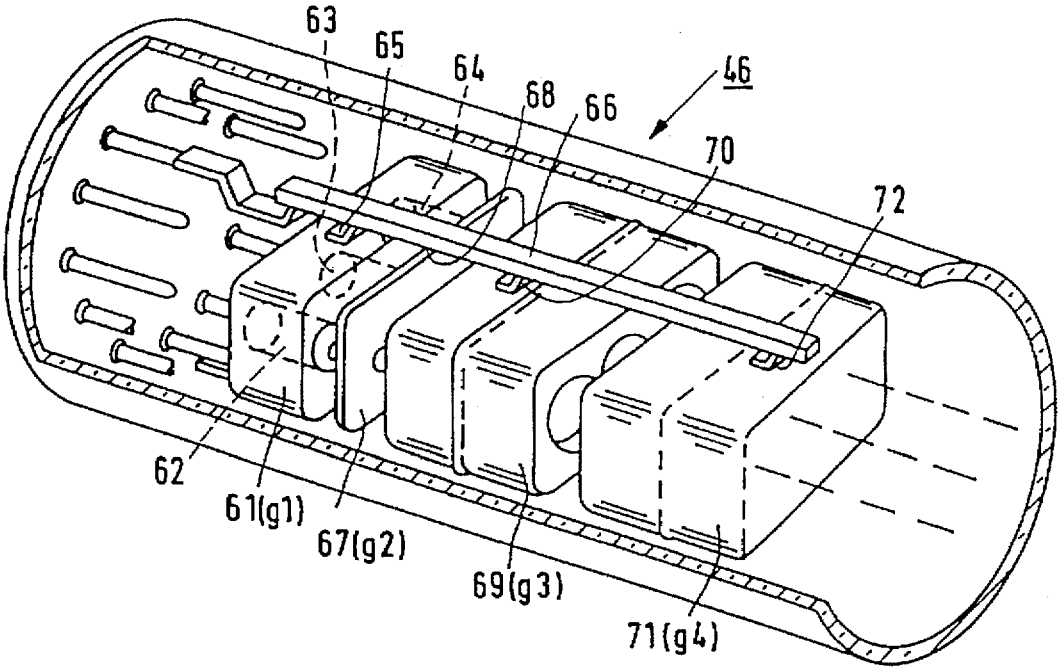
FIG. 1B is a partly perspective view of an electron gun.

FIG. 1B is a partly perspective view of an electron gun 46. Said electron gun 46 has a common control electrode 61, also referred to as $g_1$ electrode, in which three cathode structures 62, 63 and 64 are secured. Said $g_1$ electrode is secured to supports 66 by means of connecting elements 65. Said supports are made of glass. The electron gun 46 further comprises, in this example, a common plate-shaped electrode 67, also referred to as $g_2$ electrode, which is secured to the supports 66 by connecting elements 68. In this example, said electron gun 46 comprises two supports 66. One of said supports is shown, the other is situated on the side of the electron gun 46 which is invisible in this perspective view. The electron gun 46 further includes the common electrodes 69 and 71, which are also secured to supports 66 by means of connecting elements.

Figure 2A:
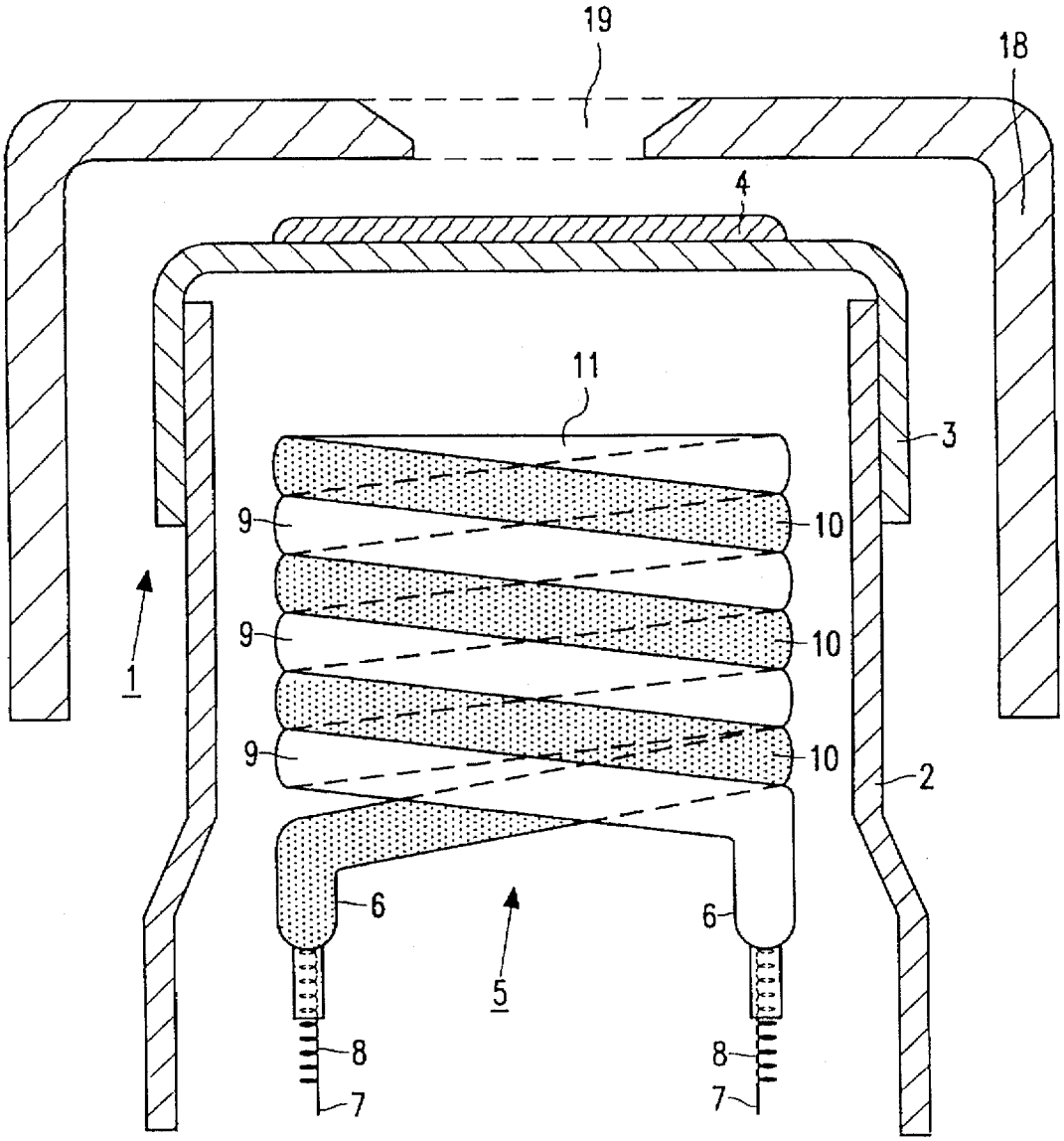
FIG. 2A PRIOR ART
FIG. 2A is a view, partly in cross-section, of a cathode structure in accordance with the prior art.

FIG. 2A is a schematic view, partly in cross-section, of a cathode structure in accordance with the prior art. This cathode structure comprises an end portion 1 and a cathode shaft 2 which is closed by means of a cover 3 which is partly covered by an electron-emitting material 4. In this embodiment, said cover and the part of the cathode structure cooperating with said cover form the end portion 1 of the cathode structure. The cathode shaft 2 accommodates a heating element 5 which serves to heat the electron-emitting material 4. Said heating element 5 comprises a wire 7 having primary turns 8 and secondary turns 9, 10 which is bifilarly wound in the form of a double helix and which is covered by an electrically insulating layer 6. Said secondary turns are built up of a first series of turns 9 which are wound in a first direction (i.e. counterclockwise) with a pitch and which extend towards the end portion 1, and of a second series of turns 10 which extend from the end portion 1 and which are wound in the opposite direction yet with the same pitch. The first and second series of secondary turns 9, 10 are interconnected close to the end portion 1 of the cathode structure by a connecting portion 11 having primary turns 8. This connecting portion 11 has a flat shape with respect to a longitudinal axis of the cathode structure. Above the cathode structure, there are a number of electrodes, one of which is shown in FIG. 2. The electrode 18 is commonly referred to as $g_1$-electrode and comprises an aperture 19.

Figure 2B:
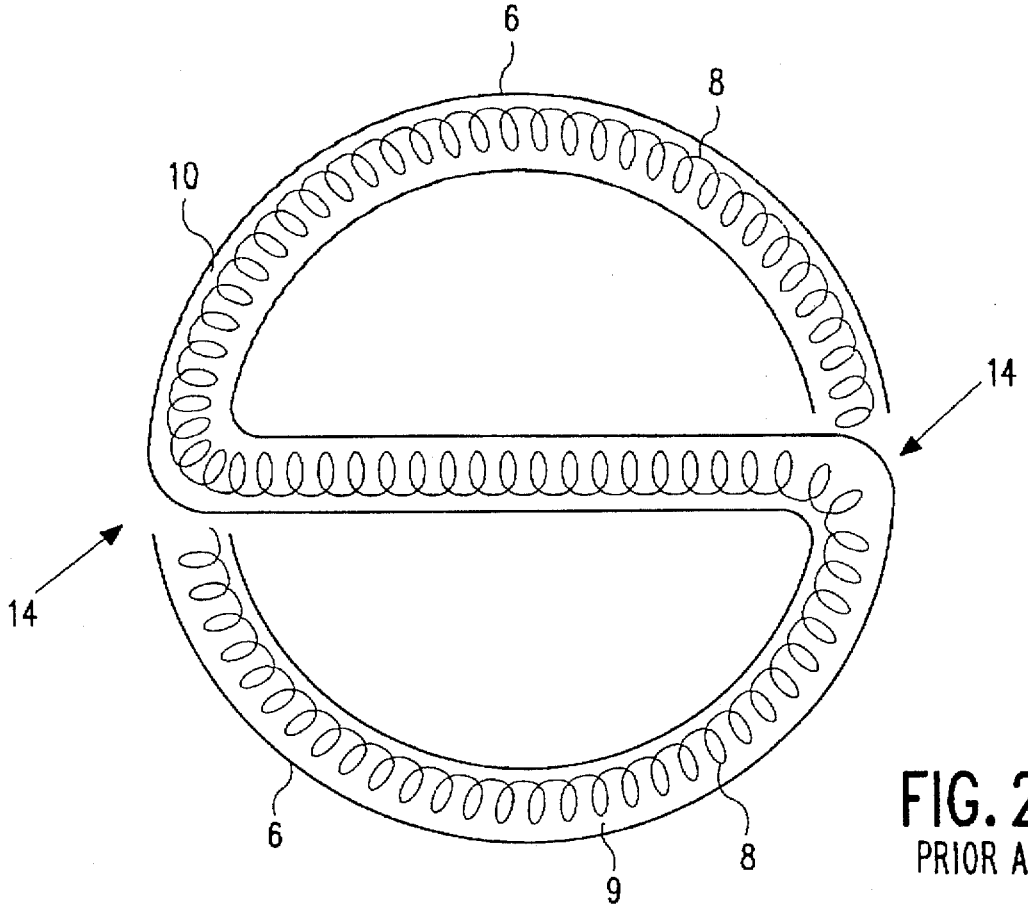
FIG. 2B PRIOR ART
FIG. 2B is a plan view of an heating element near the end portion of the cathode structure in accordance with the prior art.

FIG. 2B is a schematic plan view of the heating element 5 near the end portion 1 of the cathode structure in accordance with the prior art. In this projection, only the last half turn of the first series of secondary turns 9 is visible and only the first half turn of the second series of secondary turns 10 is visible, i.e. the half turns nearest to the end portion 1 of the cathode structure are visible. Both half turns are interconnected via the connecting portion 11. At the location of transitions 14 between the connecting portion 11 and the first and second series of secondary turns 9, 10, the helically wound wire 8, which is surrounded by the electrically insulating layer 6, exhibits a strong curvature which is caused by the flat shape of the connecting portion 11. These strongly curved transitions 14 can easily lead to short-circuits between the primary turns 8. Such short-circuits do not only reduce the efficiency of the process of heating the electron-emitting material 4, but also cause a non-uniform warmup of the heating element 5.

Figure 3B:
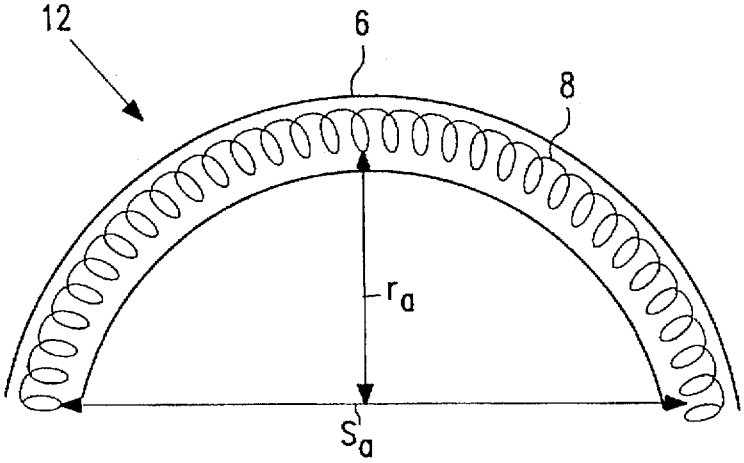
FIG. 3B is a projection of a heating element near the end portion of the cathode structure in accordance with the invention.
Figure 3A:
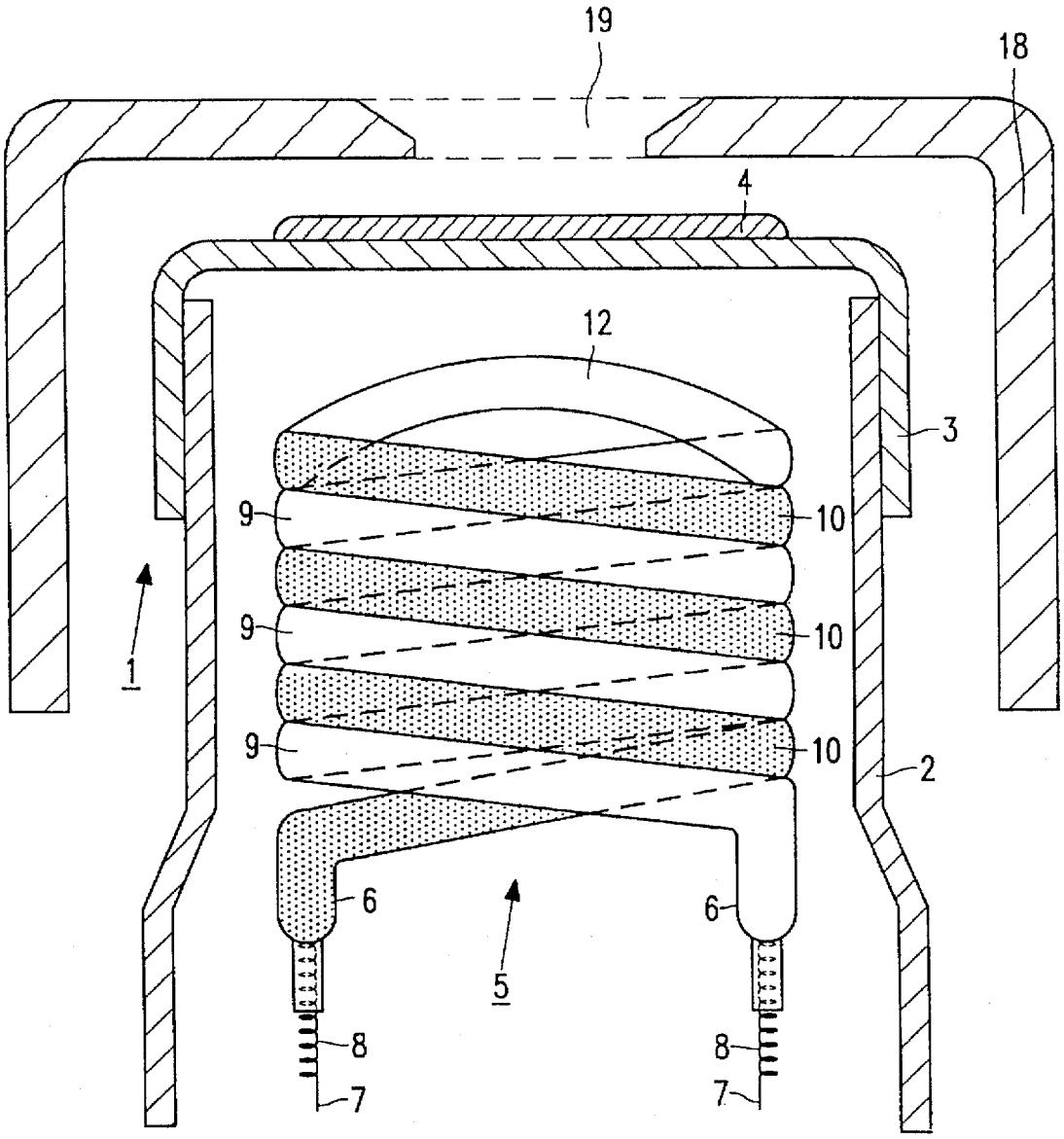
FIG. 3A is a view, partly in cross-section, of a cathode structure in accordance with the invention.

FIG. 3A is a schematic view, partly in cross-section, of a tubular cathode structure in accordance with the invention. Parts in FIG. 3A which correspond to parts in FIG. 2A bear the same reference numerals. The heating element 5 in the cathode shaft 2 comprises a wire 7 with primary turns 8 and secondary turns 9, 10, which is wound in the form of a double helix and which is covered with an electrically insulating layer 6. The secondary turns are built up of a first series of turns 9 which are wound with a pitch in a first direction and which extend towards the end portion 1, and of a second series of turns 10 which extend from said end portion 1 and which are wound in the opposite direction yet with the same pitch. The first and second series of secondary turns 9, 10 are interconnected near the end portion 1 of the cathode structure by a connecting portion 12 having primary turns 8. This connecting portion 12 is arc-shaped, so that the primary turns 8 are arranged in a flowing line with respect to each other. In addition, an arc-shaped connecting portion 12 causes the primary turns 8 to be flowing, particularly in the transitions from the connecting portion 1 to the first and second series of secondary turns 10, 12, so that the risk of short-circuits in the primary turns 8 is minimized.

FIG. 3B schematically shows the connecting portion 12 between the first and the second series of secondary turns 9, 10; the Figure clearly shows that this connecting portion 12 is not planar. In this Figure, it is indicated how the span $S_a$ and the rise $r_a$ of the arc are defined. These dimensions are measured by means of primary and secondary turns which are uncovered (see FIG. 3B). The secondary turns 9, 10 are wound around an imaginary cylinder which extends parallel to the longitudinal axis of the cathode structure. The diameter of this imaginary cylinder is equal to the span $S_a$ of the connecting portion 12. The length of the part of the heating element 5 which projects above this imaginary cylinder corresponds to the rise $r_a$ of the (arc-shaped) connecting portion 12, in other words, $r_a$ is equal to the distance between the upper face of the imaginary cylinder and the primary turns 8 in the uppermost part of the (arc-shaped) connecting portion 12. Preferably, this uppermost part of the connecting portion 12 corresponds to the longitudinal axis of the cathode structure. Given the span $S_a$ and a rise $r_a$ of the arc-shaped connecting portion 12, the primary turns 8 can be closely spaced by choosing the ratio $r_a/S_a$ in the range from 0.3 to 1.0 ($0.3 \leqq R_a/S_a \leqq 1.0$). Preferably, the ratio $r_a/S_a$ is chosen in the range from 0.3 to 0.5 ($0.3 \leqq r_a/S_a \leqq 0.5$), so that the connecting portion 12 obtains a somewhat flattened shape relative to the longitudinal axis of the cathode structure. An optimum density of primary turns 8 in the connecting portion 12 of the heating element 5 is obtained by choosing the ratio of the span to the rise of the arc-shaped connecting portion $r_a/S_a$ to be in the range from 0.3 to 0.5 ($0.3 \leqq r_a/S_a \leqq 0.5$).

Figure 3C:
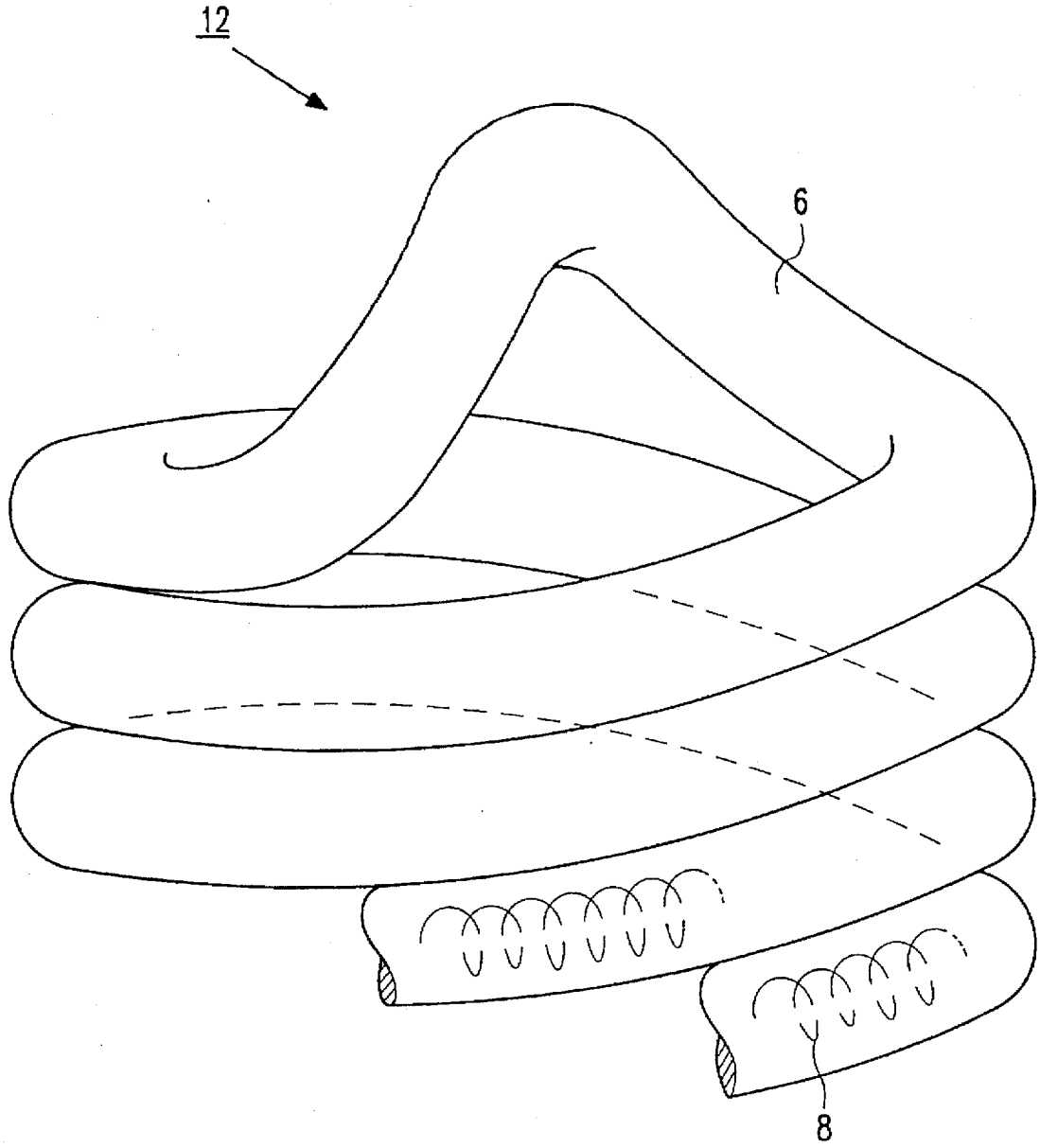
FIG. 3C is a view, rotated through approximately 90° relative to FIG. 2B, of the connecting portion between the first and second series of secondary turns in accordance with the invention.

FIG. 3C shows a schematic view, rotated through approximately 90° with respect to FIG. 3B, of the connecting portion 12 between the first and the second series of secondary turns 9, 10, in accordance with the invention. In this view, only a limited number of turns of the first series of secondary turns 9 and of the second series of secondary turns 10 are visible. Said turns 9, 10 are interconnected via the connecting portion 12. By virtue of the arc shape of this connecting portion, short-circuits between the primary turns 8 in the connecting portion 12 are precluded, so that the electron-emitting material 4 is more efficiently heated and, in addition, the heating element 5 is uniformly warmed up.

Figure 4:
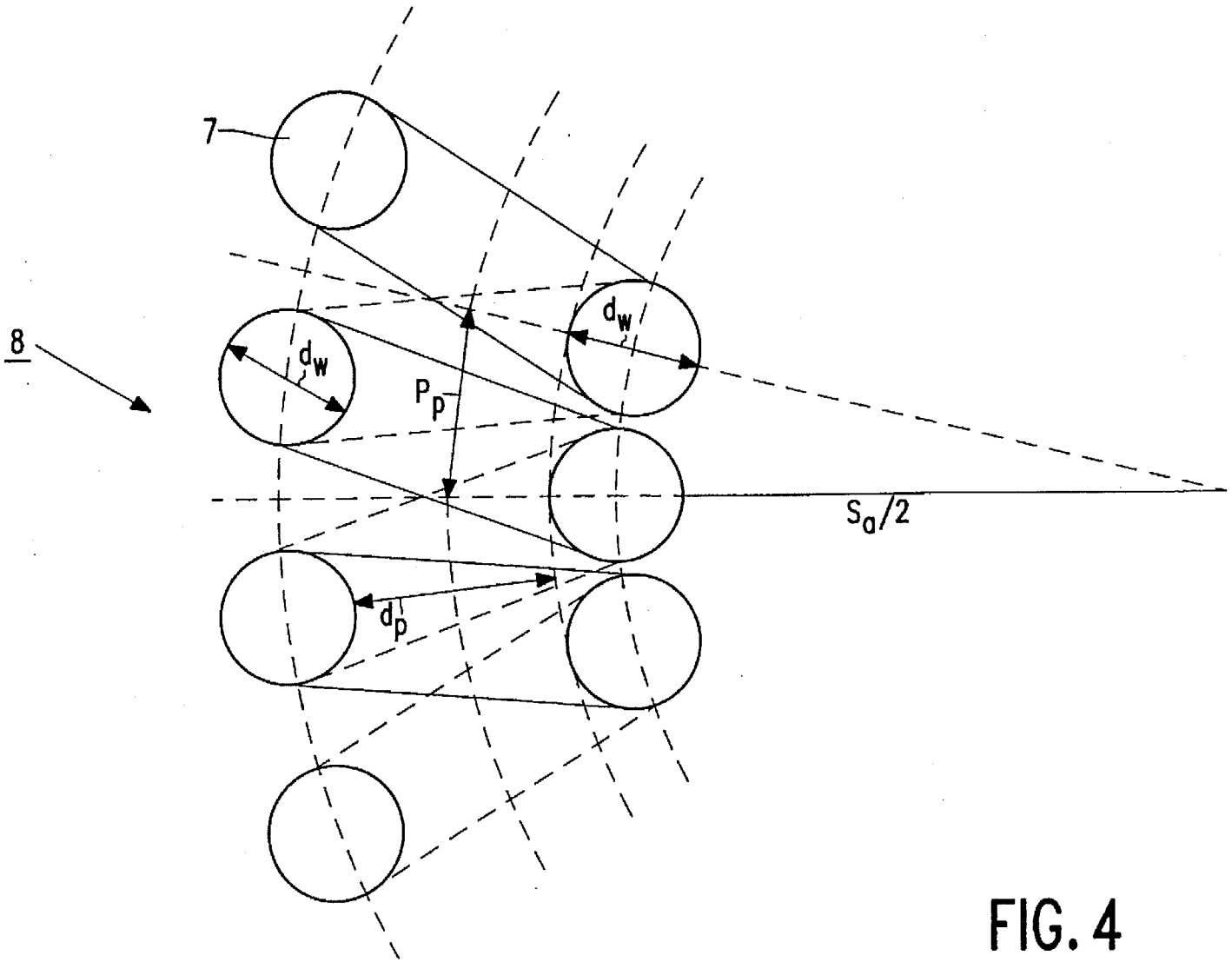
FIG. 4 is a cross-sectional view of a number of primary turns (of the transitions) of the connecting portion between the first and second series of secondary turns in accordance with the invention.

In addition to an optimum density of the primary turns in the connecting portion 12, the invention aims at precluding electrical contact between the primary turns 8 in the transitions from the connecting portion 12 to the first and second series of secondary turns 9, 10. A short-circuit in the primary turns is precluded if the connecting portion 12 is arc-shaped ($r_a/S_a \geqq 0.1$) and:

$$f_w \leqq 1.5\, d_w$$

in which:

$$f_w = (S_a/2 - d_p/2) \sin\left[\frac{P_p}{S_a/2 + d_p/2 + d_w}\right]$$

in which $d_w$ is the diameter of the wire 7, $d_p$ is the internal diameter of the primary turns 8, $P_p$ is the average pitch of the primary turns 8 and $S_a$ is the span of the arc-shaped connecting portion 12, with the argument of the sine being expressed in radials. FIG. 4 is a schematic cross-sectional view of a limited number of primary turns 8 of the wire 7 wound in the form of a double helix in the arc-shaped connecting portion 12 between the first and the second series of secondary turns 9, 10, in which the symbols used in the formula $f_w$ are indicated. During the manufacture of the primary turns 8, the wire 7 is wound on to a so-called mandrel wire having a diameter $d_p$. After this mandrel wire has been removed, the "internal" diameter $d_p$ of the primary turns 8 is maintained. When the primary turns 8 undergo a secondary winding operation to form the first and second series of secondary turns 9, 10, the pitch of the primary turns changes as a result of the curvature of the secondary turns. The "average" pitch of the primary turns indicates the distance between two successive turns of the primary turns 8 measured halfway between the primary turns (see FIG. 4).

Figure 5:
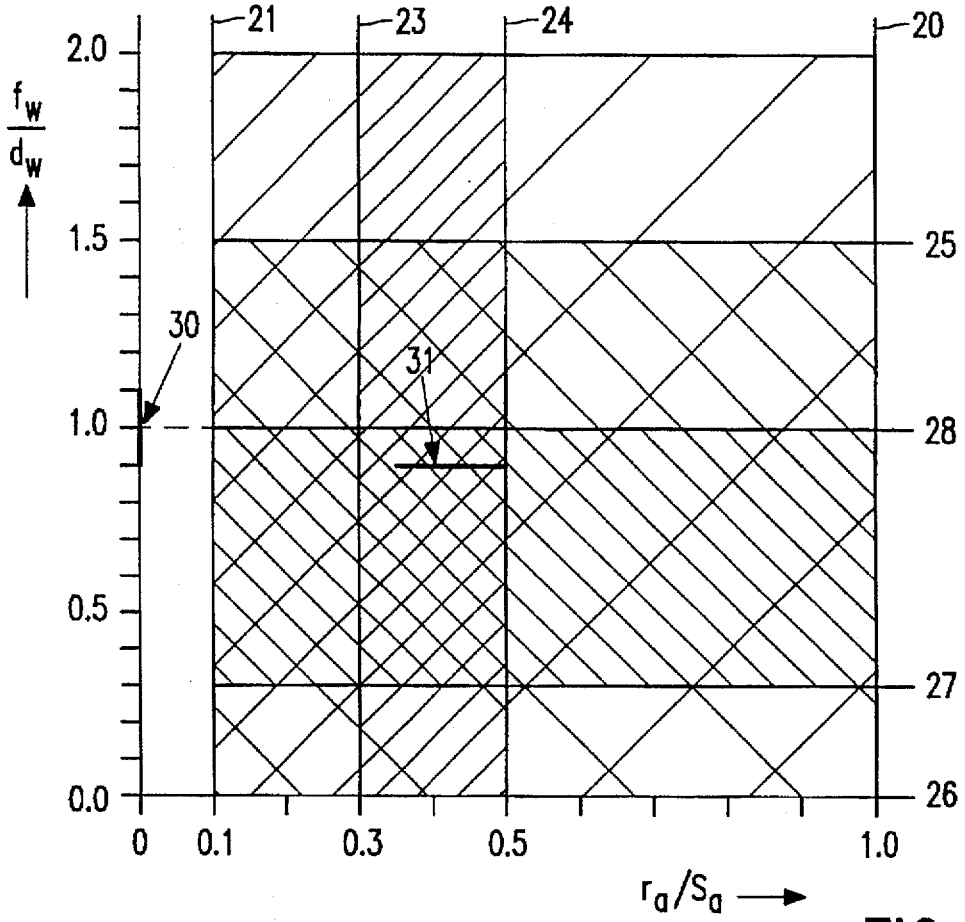
FIG. 5 is an example of the parameter ranges and preferred parameter ranges to which the combination of values of $R_a/S_a$ and of $f_w/d_w$ in accordance with the invention relates.

FIG. 5 shows an example of the parameter ranges and preferred parameter ranges to which the combination of values of $r_a/S_a$ and of $f_w/d_w$ in accordance with the invention relates. In FIG. 5, the range for which $0.1 \leqq r_a/S_a \leqq 1.0$ is bounded by the vertical lines 21 and 20, the range for which $0.1 \leqq r_a/S_a \leqq 0.5$ is bounded by the vertical lines 21 and 24, and the range for which $0.3 \leqq r_a/S_a \leqq 0.5$ is bounded by the vertical lines 23 and 24. In FIG. 5, the range for which $f_w/d_w \leqq 1.5$ is bounded by the horizontal lines 25 and 26 (line 26 corresponds to $f_w/d_w=0$). Preferably, the wire parameters and the winding ratios are chosen to be in the range:

$$0.3\ d_w \leqq f_w \leqq 1.5\ d_w$$

In FIG. 5, this range is bounded by the horizontal lines 25 and 27. Preferably, the wire parameters and the winding ratios are chosen to be in the range:

$$0.3\ d_w \leqq f_w \leqq 1.0\ d_w$$

In FIG. 5, this range is bounded by the horizontal lines 27 and 28. Tolerances during the manufacture of the heating elements 5 may lead to an upper limit $f_w/d_w \leqq 1.1$ instead of 1.0. Combination of preferred parameter ranges for $r_a/S_a$ and $f_w/d_w$ results in a rectangle in FIG. 5, which is bounded by the vertical lines 23 and 24 and by the horizontal lines 27 and 28.

Exemplary embodiment

Table 1 shows an example of an embodiment of a heating element in accordance with the invention.

TABLE 1

Embodiment of a heating element in accordance with the invention.

| | symbol | value (μm) |
|---|---|---|
| span of the arc-shaped connecting portion 12 | $S_a$ | 420 |
| rise of the arc-shaped connecting portion 12 | $r_a$ | 185 |
| diameter of the wire 7 | $d_w$ | 27 |
| diameter of the primary turn 8 | $d_p$ | 106 |
| pitch of the primary turn 8 | $P_p$ | 45.5 |

In the example given in Table 1, the $r_a/S_a$ ratio is 0.44, which is in the range from 0.1 to 1.0, particularly in the preferred range from 0.1 to 0.5, and preferably in the range from 0.3 to 0.5. Entering the values from Table 1 in the formula $f_w$ gives:

$$f_w = \left(\frac{420}{2} - \frac{106}{2}\right) \sin\left[\frac{45.5}{\frac{420}{2} + \frac{106}{2} + 27}\right]$$

or $$f_w = 157 \sin(0.1569) = 24.5 < d_w = 27\ \mu m$$

Consequently, the heating element of the exemplary embodiment meets the requirements of the invention ($f_w \leqq 1.5\ d_w$). In addition, the calculated value ($f_w$=24.5 μm=0.91 $d_w$) is in the preferred range, i.e. in the range between 0.3 $d_w$ and 1.5 $d_w$, particularly in the preferred range between 0.3 $d_w$ and 1.0 $d_w$. Thus, the heating element of the exemplary embodiment meets the requirements of the invention.

Figure 6:
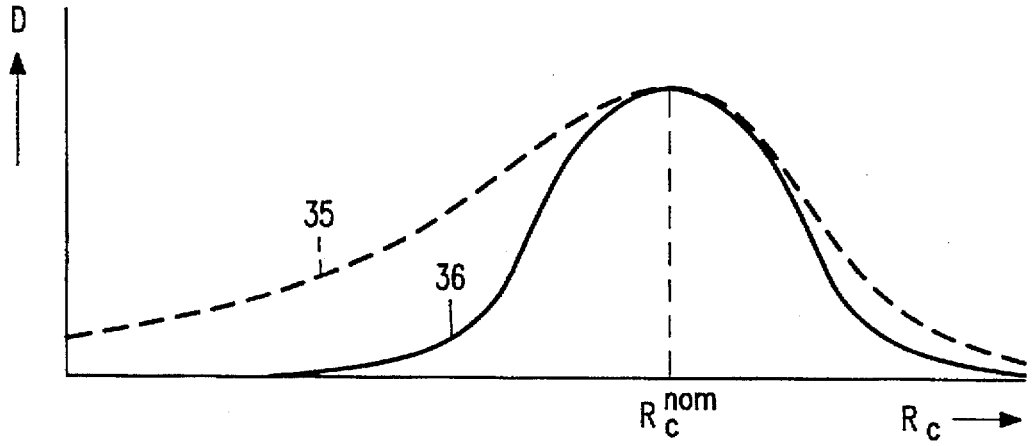
FIG. 6 shows a distribution of the cold resistance of heating elements for cathode structures in accordance with the prior art and in accordance with the invention, respectively.

Short-circuits between the (primary) turns of a heating element for use in a cathode structure influence the value of the so-called "cold" resistance $R_c$. This resistance value is measured when the heating element is at room temperature: the lower the "cold" resistance for at least substantially identical heating elements, the more turns are short-circuited. During the manufacture of such heating elements the value of $R_c$ is measured regularly. FIG. 6 shows a distribution D of the cold resistance $R_c$ of heating elements 5 for cathode structures in accordance with the prior art and in accordance with the invention. The curves 35, 36 represent the average of a large number of measurements of the "cold" resistance $R_c$. The nominal value of the resistance is indicated by $R_c^{nom}$, in FIG. 6. Distribution curve 35 corresponds to wire parameters which correspond to line segment 30 in FIG. 5 ($r_a/S_a$=0). The asymmetric distribution of the "cold" resistance is indicative of a number of short-circuited (primary) turns 8. Distribution curve 36 corresponds to wire parameters which correspond to line segment 31 in FIG. 5 ($0.35 \leqq r_a/S_a \leqq 0.5$ and $f_w/d_w \approx 0.91$). The absence of short-circuited (primary) turns leads to a symmetric distribution of the "cold" resistance.

It will be obvious that within the scope of the invention many variations are possible to those skilled in the art. The argument of the sine in the formula $f_w$ is very small, so that the sine can be replaced by the argument itself. A further simplification can then be obtained in various ways.

In general, the invention relates to a cathode structure which comprises an electron-emitting material at an end portion and a filamentary heating element having a plurality of primary helical turns. These primary turns are used to form a first series of secondary turns which are wound in a first direction with a pitch and extend towards the end portion, and a second series of secondary turns which extend from the end portion in the opposite direction of winding yet with the same pitch of. Near the end portion, the first and second series of turns are interconnected by an arc-shaped connecting portion having primary turns. This arc-shaped connecting portion has a span $S_a$ and a rise $r_a$, the ratio $r_a/S_a$ preferably ranging from 0.3 to 0.5.

I claim:

1. A cathode structure which comprises an electron-emitting material at an end portion, and in which there is a filamentary heating element comprising a plurality of primary, helical turns with which a first series of secondary turns is formed, which are wound in a first direction with a pitch and which extend in the direction of said end portion, and with which a second series of secondary turns is formed which extend from said end portion and which are wound in the opposite direction yet with the same pitch, said first and second series of turns being interconnected at the end portion by a connecting portion with primary turns, characterized in that the connecting portion is arc-shaped with a span $S_a$ and a rise $r_a$, the ratio $r_a/S_a$ ranging from 0.1 to 1.0.

2. A cathode structure as claimed in claim 1, characterized in that the ratio $r_a/S_a$ ranges from 0.1 to 0.5.

3. A cathode structure as claimed in claim 2, characterized in that the ratio $r_a/S_a$ ranges from 0.3 to 0.5.

4. A cathode structure as claimed in any one of claims 1 to 3, characterized in that, in the connecting portion, a diameter $d_w$ of the wire, an internal diameter $d_p$ of the primary turns and an average pitch $P_p$ of the primary turns satisfy the relationship:

$$(S_a/2 - d_p/2)\sin\left[\frac{P_p}{S_a/2 + d_p/2 + d_w}\right] \leqq 1.5\, d_w$$

in which the argument of the sine is expressed in radials.

5. A cathode structure as claimed in claim 4, characterized in that:

$$0.3\, d_w \leqq (S_a/2 - d_p/2)\sin\left[\frac{P_p}{S_a/2 + d_p/2 + d_w}\right] \leqq 1.5\, d_w.$$

6. A cathode structure as claimed in claim 5, characterized in that:

$$0.3\, d_w \leqq (S_a/2 - d_p/2)\sin\left[\frac{P_p}{S_a/2 + d_p/2 + d_w}\right] \leqq 1.0\, d_w.$$

7. A cathode structure as claimed in any one of claims 1 to 3, characterized in that the diameter $d_w$ of the wire exceeds 20 μm.

8. A cathode structure as claimed in any one of claims 1 to 3, characterized in that the internal diameter $d_p$ of the primary turns exceeds 100 μm.

9. A cathode structure as claimed in any one of claims 1 to 3, characterized in that the span $S_a$ of the connecting portion is smaller than 500 μm.

10. A cathode ray tube comprising an electron source which includes a cathode structure having a heating element as claimed in any one of claims 1 to 3.

* * * * *